US009734778B2

(12) United States Patent
Shin et al.

(10) Patent No.: US 9,734,778 B2
(45) Date of Patent: Aug. 15, 2017

(54) DISPLAY APPARATUS HAVING INCREASED LATERAL IMAGE QUALITY

(71) Applicant: SAMSUNG DISPLAY CO., LTD., Yongin-si, Gyeonggi-Do (KR)

(72) Inventors: Donghwa Shin, Yongin-si (KR); Jung-won Kim, Seoul (KR); Hyang-a Park, Seoul (KR); Jaesung Bae, Suwon-si (KR); Seunghwan Park, Anyang-si (KR); Jaehyung Cho, Suwon-si (KR)

(73) Assignee: SAMSUNG DISPLAY CO., LTD., Yongin-si, Gyeonggi-Do (KR)

( * ) Notice: Subject to any disclaimer, the term of this patent is extended or adjusted under 35 U.S.C. 154(b) by 135 days.

(21) Appl. No.: 14/862,372

(22) Filed: Sep. 23, 2015

(65) Prior Publication Data

US 2016/0275843 A1 Sep. 22, 2016

(30) Foreign Application Priority Data

Mar. 16, 2015 (KR) ..... 10-2015-0036214

(51) Int. Cl.
*G09G 3/36* (2006.01)

(52) U.S. Cl.
CPC ..... *G09G 3/3614* (2013.01); *G09G 3/3607* (2013.01); *G09G 3/3648* (2013.01); (Continued)

(58) Field of Classification Search
CPC .. G09G 3/3614; G09G 3/3648; G09G 3/3607; G09G 3/364; G09G 3/3666; G09G 3/2074; G09G 2300/0443; G09G 2300/0452; G09G 2300/0463; G09G 2300/0809; G09G 2300/0439; G09G 2320/0673; G09G 2320/0233; (Continued)

(56) References Cited

U.S. PATENT DOCUMENTS 8,502,762 B2 8/2013 Kamada et al.
2010/0156948 A1* 6/2010 Kim ..... G09G 3/2096 345/690

(Continued)

FOREIGN PATENT DOCUMENTS

KR 1020080040900 5/2008
KR 1020140003146 1/2014

(Continued)

*Primary Examiner* — Larry Sternbane
(74) *Attorney, Agent, or Firm* — F. Chau & Associates, LLC

(57) ABSTRACT

A display apparatus includes a dot formed from a plurality of pixels. Each pixel displays a grayscale that is a sum of a first image displayed during an Nth frame and a second image displayed during an (N+1)th frame. N is an integer equal to or greater than 1. The dot includes first and second pixels having a first color, the first pixel displaying an image having a first grayscale based on a first gamma curve, and the second pixel displaying an image having a second grayscale based on a second gamma curve. Third and fourth pixels have a second color and display images having the first grayscale based on the first gamma curve. Fifth and sixth pixels have a third color and display images having the second grayscale based on the second gamma curve.

20 Claims, 9 Drawing Sheets

(52) U.S. Cl.
CPC ..... *G09G 2300/0443* (2013.01); *G09G 2320/0233* (2013.01); *G09G 2320/0673* (2013.01); *G09G 2370/08* (2013.01)

(58) Field of Classification Search
CPC ..... G09G 2340/10; G09G 2340/16; G09G 2340/0457; G09G 2370/08
See application file for complete search history.

(56) References Cited

U.S. PATENT DOCUMENTS

| | | | | |
|---|---|---|---|---|
| 2012/0206638 | A1* | 8/2012 | Saitoh ..... | G09G 3/3611 348/333.05 |
| 2013/0321483 | A1* | 12/2013 | You ..... | G09G 5/10 345/690 |

FOREIGN PATENT DOCUMENTS

| | | |
|---|---|---|
| KR | 1020140003242 | 1/2014 |
| KR | 1020140033951 | 3/2014 |
| KR | 1020140104259 | 8/2014 |

* cited by examiner

DISPLAY APPARATUS HAVING INCREASED LATERAL IMAGE QUALITY

CROSS-REFERENCE TO RELATED APPLICATION(S)

This application claims priority under 35 U.S.C. §119 to Korean Patent Application No. 10-2015-0036214, filed on Mar. 16, 2015, the contents of which are incorporated by reference herein in their entirety.

TECHNICAL FIELD

The present disclosure herein relates to a display apparatus, and more particularly, to a display apparatus having an increased lateral image quality.

DISCUSSION OF THE RELATED ART

In general, a liquid crystal display apparatus may be driven in a manner that liquid crystals are injected between upper and lower substrates having transparent electrodes formed thereon. Upper and lower polarizing plates may be disposed at outsides of the upper and lower substrates, respectively, so an arrangement of the liquid crystals may be changed between the upper and lower substrates. Thus, transmittance of light may be adjusted.

The liquid crystal display apparatus may employ an in-plane mode or a vertical alignment mode. In the vertical alignment mode, a liquid crystal alignment is initially formed perpendicular to the substrates. In this state, when a voltage is applied between the electrodes of the upper/lower substrates, an optical axis of a liquid crystal layer may move while the liquid crystals rotate in a polar angle direction. Thus, the polarization of light may be controlled.

In general, a liquid crystal display apparatus of the vertical alignment mode may employ a technique of dividing one pixel into two subpixels to increase lateral image quality. In the pixel division technique, the number of signal wirings and the number of thin film transistors are increased to independently drive the two subpixels. Therefore, the liquid crystal display apparatuses having a pixel division structure have a relatively low aperture ratio.

SUMMARY

The present inventive concept relates to a display apparatus having an increased aperture ratio.

In an exemplary embodiment of the present inventive concept, a display apparatus includes a dot formed from a plurality of pixels. Each pixel displays a grayscale that is a sum of a first image displayed during an N-th frame and a second image displayed during an (N+1)th frame. N is an integer equal to or greater than 1. The dot includes first and second pixels having a first color, the first pixel displaying an image having a first grayscale based on a first gamma curve, and the second pixel displaying an image having a second grayscale based on a second gamma curve. A third and a fourth pixel have a second color, the third pixel displaying an image having the first grayscale based on the first gamma curve, and the fourth pixel displaying an image having the first grayscale based on the first gamma curve. A fifth and a sixth pixel have a third color, the fifth pixel displaying an image having the second grayscale based on the second gamma curve, and the sixth pixel displaying an image having the second grayscale based on the second gamma curve.

According to an exemplary embodiment of the present inventive concept, the first, second, and third colors are red, green, and blue colors, respectively.

According to an exemplary embodiment of the present inventive concept, the first, second, and third colors are blue, green, and red colors, respectively.

According to an exemplary embodiment of the present inventive concept, each pixel in the dot receives a data voltage having a polarity inverted at every period of one frame.

According to an exemplary embodiment of the present inventive concept, each pixel in the dot receives a data voltage having a polarity inverted at every period of two frames.

According to an exemplary embodiment of the present inventive concept, the first, third, and fifth pixels are located on a k-th row, and the second, fourth, and sixth pixels are located on a (k+1)th row.

According to an exemplary embodiment of the present inventive concept, a display apparatus further includes a plurality of gate lines extending in a first direction, and a plurality of data lines extending in a second direction crossing the first direction, wherein the first, third, and fifth pixels are connected to a k-th gate line, among the plurality of gate lines, and the second, fourth, and sixth pixels are connected to a (k+1)th gate line, among the plurality of gate lines.

According to an exemplary embodiment of the present inventive concept, the first pixel is connected to a j-th data line, the third pixel is connected to a (j+1)th data line, and the fifth pixel is connected to a (j+2)th data line, and wherein the second pixel is connected to the (j+1)th data line, the fourth pixel is connected to the (j+2)th data line, and the sixth pixel is connected to the (j+3)th data line.

According to an exemplary embodiment of the present inventive concept, polarities of a data voltages applied to the plurality of data lines is inverted at every consecutive data line.

According to an exemplary embodiment of the present inventive concept, the first and second gamma curves have different luminance values at the same grayscale.

According to an exemplary embodiment of the present inventive concept, the first gamma curve has a luminance value lower than a luminance value of the second gamma curve at the same grayscale.

According to an exemplary embodiment of the present inventive concept, each of the N-th and (N+1)th frames has a sectional width of about 1/120 ms.

In an exemplary embodiment of the present inventive concept, a display apparatus includes a plurality of pixel groups for displaying images, wherein each pixel group of the plurality of pixel groups includes a plurality of pixels. Each pixel of at least one pixel group of the plurality of pixel groups displays a grayscale by adding a first image displayed during an Nth frame and a second image displayed during an (N+1)th frame. N is an integer equal to or greater than 1. The at least one pixel group includes first and second pixels having a first color, the first pixel displaying an image having a first grayscale based on a first gamma curve, and the second pixel displaying an image having the first grayscale based on the first gamma curve. A third and a fourth pixel have a second color, the third pixel displaying an image having a second grayscale based on a second gamma curve, and the fourth pixel displaying an image having the second grayscale based on the second gamma curve. A fifth and a sixth pixel have a third color, the fifth pixel displaying an image having the first grayscale based on the first gamma curve, and the sixth pixel displaying an image having the second grayscale based on the second gamma curve.

According to an exemplary embodiment of the present inventive concept, the first, second, and third colors are red, green, and blue colors, respectively.

According to an exemplary embodiment of the present inventive concept, each pixel of the at least one pixel group receives a data voltage having a polarity inverted at a period of one frame.

According to an exemplary embodiment of the present inventive concept, each pixel of the at least one pixel group receives a data voltage having a polarity inverted at a period of two frames.

According to an exemplary embodiment of the present inventive concept, the first, third, and fifth pixels are located on a k-th row, and the second, fourth, and sixth pixels are located on a (k+1)th row.

According to an exemplary embodiment of the present inventive concept, a display apparatus further includes a plurality of gate lines extending in a first direction, and a plurality of data lines extending in a second direction crossing the first direction, wherein the first, third, and fifth pixels are connected to a k-th gate line, among the plurality of gate lines, and the second, fourth, and sixth pixels are connected to a (k+1)th gate line, among the plurality of gate lines.

According to an exemplary embodiment of the present inventive concept, the first pixel is connected to a j-th data line, the third pixel is connected to a (j+1)th data line, and the fifth pixel is connected to a (j+2)th data line, and wherein the second pixel is connected to the (j+1)th data line, the fourth pixel is connected to the (j+2)th data line, and the sixth pixel is connected to the (j+3)th data line.

In an exemplary embodiment of the present inventive concept, a display apparatus includes a dot. The dot includes a plurality of pixels for displaying images. Each pixel in the dot displays a grayscale by adding a first image displayed during a first frame and a second image displayed during a second frame. The dot includes first and second pixels having a first color, the first pixel displaying an image having a first grayscale based on a first gamma curve, and the second pixel displaying an image having a second grayscale based on a second gamma curve. A third and a fourth pixel have a second color, the third pixel displaying an image having the first grayscale based on the first gamma curve, and the fourth pixel displaying an image having the first grayscale based on the first gamma curve. A fifth and a sixth pixel have a third color, the fifth pixel displaying an image having the second grayscale based on the second gamma curve, and the sixth pixel displaying an image having the second grayscale based on the second gamma curve.

BRIEF DESCRIPTION OF THE DRAWINGS

The inventive concept will become more apparent by describing in detail exemplary embodiments thereof with reference to the accompanying drawings in which.

DETAILED DESCRIPTION OF THE EMBODIMENTS

Figure 1:
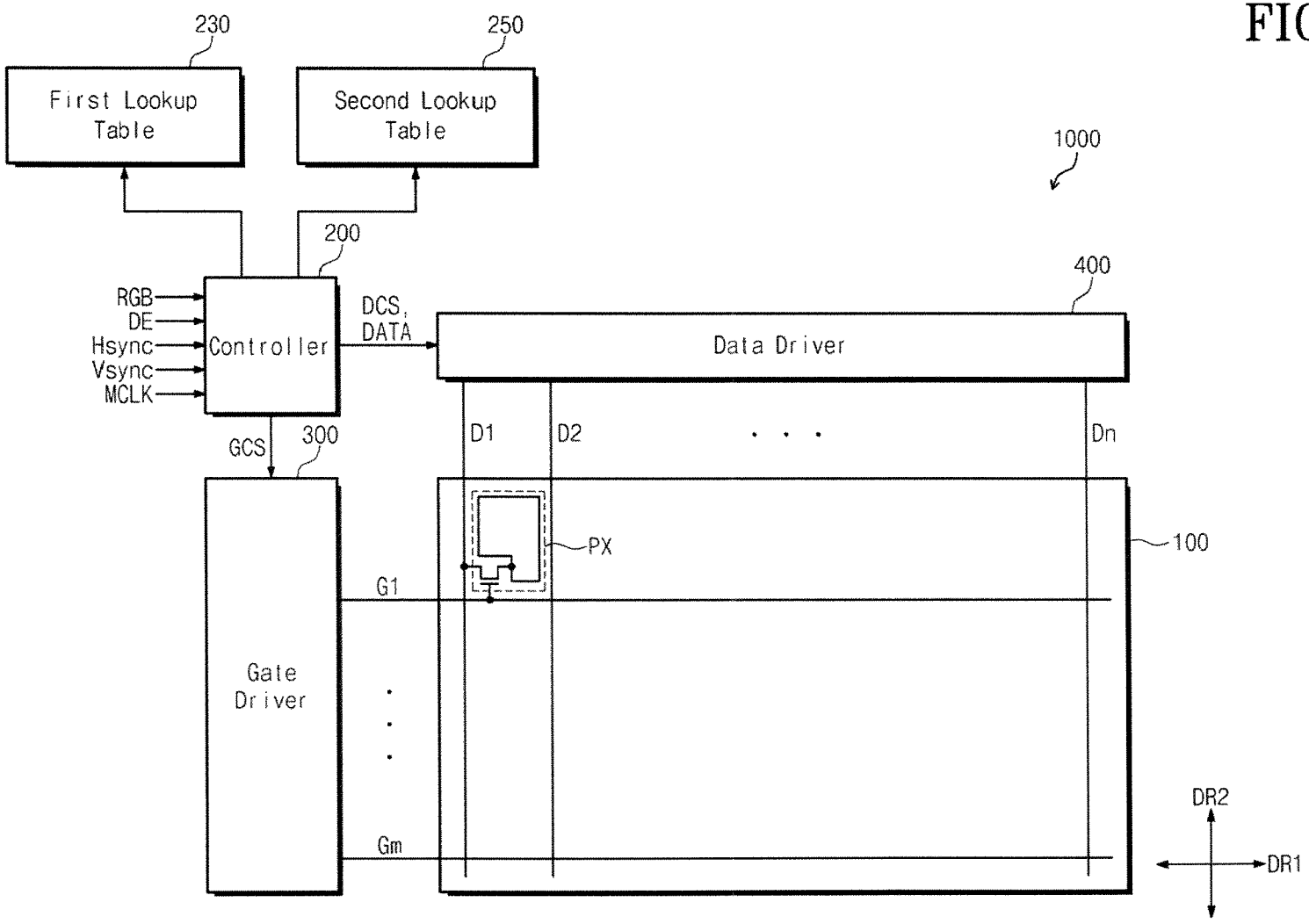
FIG. 1 is a block diagram showing a display apparatus according to an exemplary embodiment of the inventive concept.

Hereinafter, exemplary embodiments of the inventive concept will be described in detail with reference to the accompanying drawings.

The inventive concept will become more apparent when exemplary embodiments of the inventive concept are described with reference to the accompanying drawings. In the drawings, the thicknesses of layers and regions may be exaggerated for clarity. In the drawings, like elements may be referred to using like reference numerals. Moreover, detailed descriptions of well-known functions or configurations may be omitted for brevity.

Figure 2:
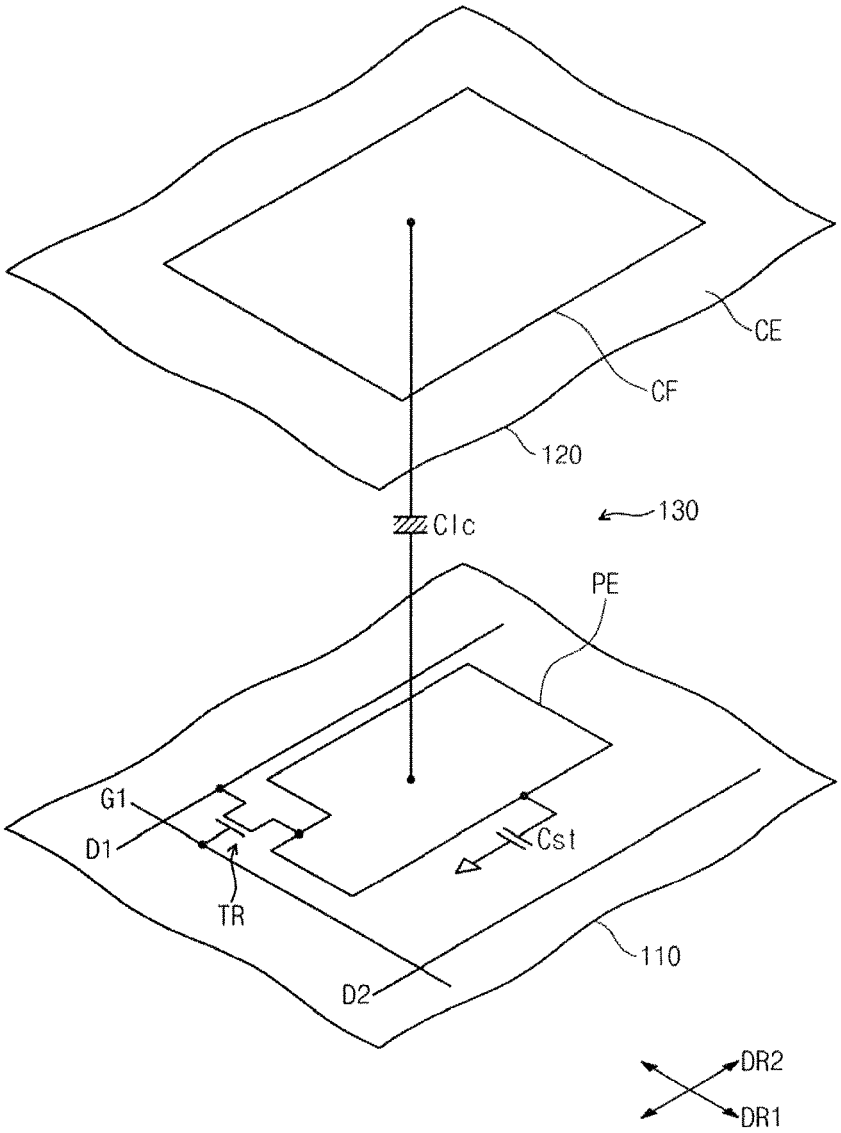
FIG. 2 is an equivalent circuit diagram of a pixel shown in FIG. 1, according to an exemplary embodiment of the inventive concept.

FIG. 1 is a block diagram showing a display apparatus according to an exemplary embodiment of the inventive concept. FIG. 2 is an equivalent circuit diagram of a pixel shown in FIG. 1, according to an exemplary embodiment of the inventive concept.

Referring to FIGS. 1 and 2, a display apparatus 1000, according to an exemplary embodiment of the inventive concept, may include a display panel 100, a controller 200, a gate driver 300, and a data driver 400.

The display panel 100 may include a lower substrate 110, an upper substrate 120 opposite to the lower substrate 110, and a liquid crystal layer 130 disposed between the lower and upper substrates 110 and 120.

The display panel 100 may include a plurality of gate lines G1 to Gm extending in a first direction DR1 and a plurality of data lines D1 to Dn extending in a second direction DR2 crossing the first direction DR1. The gate lines G1 to Gm and the data lines D1 to Dn may define pixel regions, and pixels PX for displaying an image may be provided in the pixel regions, respectively. In FIG. 1, a 1×1 pixel PX, connected to a first gate line G1 and a first data line D1, among the plurality of pixels PX, is illustrated as an example. However, exemplary embodiments of the inventive concept are not limited thereto.

The 1×1 pixel PX may include a thin film transistor TR connected to the first gate line G1 and the first data line D1, a liquid crystal capacitor Clc connected to the thin film transistor TR, and a storage capacitor Cst connected in parallel to the liquid crystal capacitor Clc. The storage capacitor Cst may be omitted. The liquid crystal capacitor Clc may use, as two terminals, a pixel electrode PE provided on the lower substrate 110 and a common electrode CE provided on the upper substrate 120. The liquid crystal layer 130 may be disposed between the pixel and common electrodes PE and CE and may act as a dielectric.

The thin film transistor TR may be provided on the lower substrate 110. A gate electrode of the thin film transistor TR may be connected to the first gate line G1, a source electrode of the thin film transistor TR may be connected to the first data line D1, and a drain electrode of the thin film transistor TR may be connected to the pixel electrode PE. The common electrode CE may be formed on the upper substrate 120 and may receive a common voltage. Unlike as shown in FIG. 2, the common electrode CE may be disposed on the lower substrate 110. In this case, at least one of the pixel and common electrodes PE and CE may have a slit.

The storage capacitor Cst may perform an auxiliary function of the liquid crystal capacitor Clc, and may include the pixel electrode PE, a storage line, and an insulator disposed between the pixel electrode PE and the storage line. The storage line may be provided on the lower substrate 110 to overlap with a portion of the pixel electrode PE. A fixed voltage such as a storage voltage may be applied to the storage line.

Each of the pixels PX may display a primary color, from among a plurality of primary colors. The primary colors may be red, green and blue. Each of the pixels PX may further display any one of white, yellow, cyan, and magenta colors. Each of the pixels PX may further include a color filter CF for filtering light passing therethrough to become light of a selected wavelength. In FIG. 2, it is exemplarily illustrated that the color filter CF is provided on the upper substrate 120. However, the inventive concept is not limited thereto, and the color filter CF may be provided on the lower substrate 110.

The controller 200 receives image data RGB and a control signal from an external graphic controller. The control signal may include a vertical synchronization signal (Vsync signal), which is a frame discrimination signal, a horizontal synchronization signal (Hsync signal), which is a row discrimination signal, a data enable signal (DE) signal, which has a high level during a period of time in which data is output to display a zone where the data is input, and a main clock signal (MCLK).

The controller 200 converts the image data RGB to be suitable for the specification of the data driver 400 and outputs the converted image data DATA to the data driver 400. The controller 200 generates a gate control signal GCS and a data control signal DCS. The controller 200 outputs the gate control signal GCS to the gate driver 300, and outputs the data control signal DCS to the data driver 400.

The gate control signal GCS controls the gate driver 300, and the data control signal DCS controls the data driver 400.

The gate driver 300 may generate a gate signal in response to the gate control signal GCS, and may sequentially output the gate signal to the gate lines G1 to Gm. The gate control signal GCS may include a vertical start signal for indicating scan start, at least one clock signal for controlling the output period of a gate-on voltage, an output enable signal for limiting the duration of the gate-on voltage, and the like.

The data driver 400 may convert the image data DATA into a corresponding grayscale voltage in response to the data control signal DCS, and may output the grayscale voltage as a data voltage to a corresponding data line among the data lines D1 to Dn. The data voltage may include a positive data voltage having a positive value with respect to the common voltage and a negative data voltage having a negative value with respect to the common voltage. The data control signal DCS may include a horizontal start signal for indicating start of transmission of the image data DATA to the data driver 400, a load signal for applying the data voltage to the data lines D1 to Dn, an inverting signal for inverting the polarity of the data voltage with respect to the common voltage, and the like.

The polarity of the data voltage applied to the pixels PX may be inverted before one frame is finished and the next frame is then started to prevent deterioration of liquid crystals of the liquid crystal layer 130. For example, the polarity of the data voltage may be inverted in the unit of one frame in response to an inverting signal applied to the data driver 400. The display panel 100 may be driven in a manner that data voltages having different polarities are applied to at least one data line during a period to increase image quality when an image of one frame is displayed.

Each of the controller 200, the gate driver 300, and the data driver 400 may be disposed in at least one integrated circuit chip directly on the display panel 100, may be mounted on a flexible printed circuit board to be attached in the form of a tape carrier package (TCP) to the display panel 100, or may be mounted on a separate printed circuit board. Alternatively, at least one of the gate driver 300 and the data driver 400 may be integrated on the display panel 100 together with the gate lines G1 to Gm, the data lines D1 to Dn, and the thin film transistors TR.

Each of the pixels PX, according to an exemplary embodiment of the inventive concept, might not employ a visible pixel structure. The visible pixel structure refers to a structure in which one pixel PX is divided into two subpixels. In the visible pixel structure, high image data, having a grayscale higher than an input grayscale, may be applied to any one of the two subpixels, and low image data, having a grayscale lower than the input grayscale, may be applied to the other of the two subpixels. However, each of the pixels PX, according to an exemplary embodiment of the inventive concept, may have an invisible pixel structure in which a pixel PX is not divided into two grayscale regions. Thus an aperture ratio of each of the pixels PX may be increased when compared with the pixels PX having the visible pixel structure.

To improve lateral visibility of the display apparatus 1000 employing the invisible pixel structure, the display apparatus 1000 may be driven in a time gamma mixed (TGM) driving manner. In TGM driving, a desired grayscale is displayed by adding a first image displayed during an N-th frame and a second image displayed during an (N+1)th frame. For example, when a high level image data is applied to a corresponding pixel PX during the Nth frame, a low image data is applied to the corresponding pixel PX during the (N+1)th frame. For example, the TGM manner may be a manner that one pixel is not space-divisionally driven but time-divisionally driven while displaying images having different grayscales. Thus, lateral visibility may be improved.

The display apparatus 1000 may further include a first lookup table 230 and a second lookup table 250 to operate in the TGM driving manner.

Figure 3:
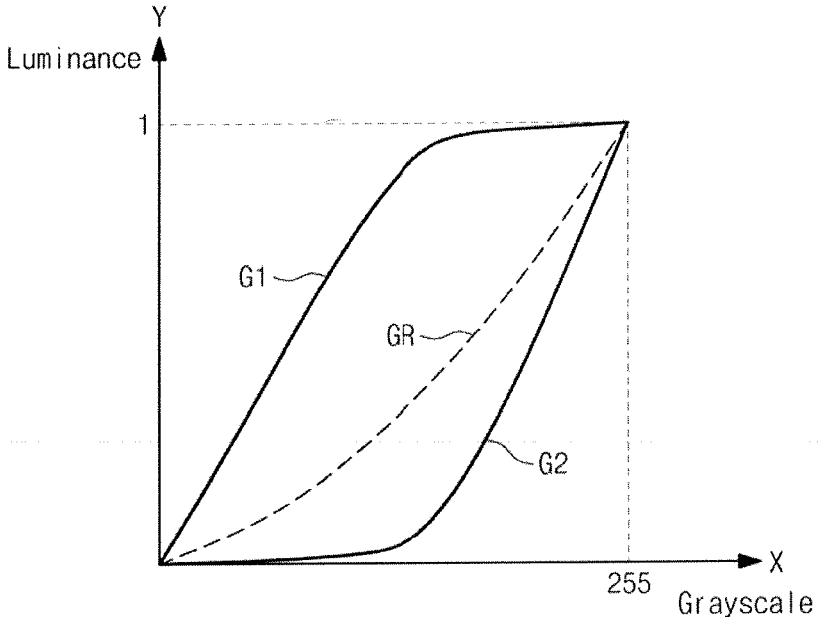
FIG. 3 is a graph showing first and second gamma curves, respectively, stored in first and second lookup tables of FIG. 1, according to an exemplary embodiment of the inventive concept.

FIG. 3 is a graph showing first and second gamma curves, respectively, stored in the first and second lookup tables of FIG. 1, according to an exemplary embodiment of the inventive concept.

Referring to FIGS. 1 and 3, the first lookup table 230 may store first sampling data sampled from a first gamma curve G1 shown in FIG. 3, and the second lookup table 250 may store second sampling data sampled from the second gamma curve G2 shown in FIG. 3.

In FIG. 3, an x-axis (e.g., a horizontal axis) may represent grayscale and an y-axis (e.g., vertical axis) may represent luminance, or transmittance (e.g., a transmittance percentile). Based on the same grayscale, the first gamma curve G1 may have a luminance higher than that of the second gamma curve G2.

FIG. 3 shows a reference gamma curve GR in which front visibility may be optimized. For example, the reference gamma curve GR may have a gamma value of 2.2. In the same grayscale, based on the reference gamma curve GR, the first gamma curve G1 may have a luminance higher than that of the reference gamma curve GR, and the second gamma curve G2 may have a luminance lower than that of the reference gamma curve GR. Here, the first and second gamma curves G1 and G2 may be gamma curves in which the lateral visibility of the display apparatus 1000 is optimized. The first and second gamma curves G1 and G2 may be generated such that when the first and second gamma curves G1 and G2 are synthesized, the reference gamma curve GR may be produced (e.g., result).

The shapes of the first and second gamma curves G1 and G2 are not limited to those shown in FIG. 3 and may be modified by various combinations of gamma curves.

When the display panel 100 displays an image using data converted based on the second gamma curve G2, the display panel 100 may display an image having a luminance lower than a luminance of an image displayed by the display panel 100 using data converted based on the first gamma curve G1. The first lookup table 230 may store, as the first sampling data, high-grayscale, high luminance data extracted from the first gamma curve G1 in previously set reference grayscales. The second lookup table 250 may store, as the second sampling data, low-grayscale, low luminance data extracted from the second gamma curve G2 in the reference grayscales.

The controller 200 may convert the input image data RGB by receiving the first and second sampling data from the first and second lookup tables 230 and 250. Information on gamma curves is included in the image data DATA converted in the controller 200 through the conversion operation.

Figure 4:
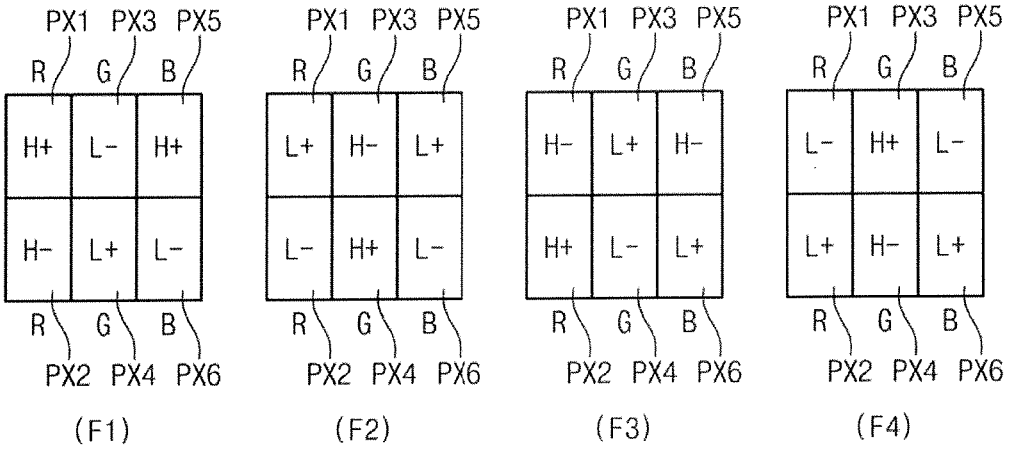
FIG. 4 is a plan view showing operation states of pixels during consecutive first to fourth frames, according to an exemplary embodiment of the inventive concept.

FIG. 4 is a plan view showing operation states of pixels during consecutive first to fourth frames, according to an exemplary embodiment of the inventive concept.

Referring to FIG. 4, the display apparatus 1000 may display an image by driving pixels during consecutive first to fourth frames F1, F2, F3, and F4. In an exemplary embodiment of the inventive concept, each of the first to fourth frames F1 to F4 may have a sectional width of about 1/120 ms. However, the inventive concept is not limited thereto.

The display panel 100 may have a structure in which a dot including a plurality of pixels PX is repeated. Each pixel PX of the dot may display a desired grayscale by adding an image displayed during an N-th frame and an image displayed during an (N+1)th frame. Here, N may be an odd number including 1 or an odd number greater than 1. Thus, each pixel may display a desired grayscale by adding a first image of the first frame F1 and a second image of the second frame F2, and then display a desired grayscale by adding a third image of the third frame F3 and a fourth image of the fourth frame F4.

In an exemplary embodiment of the inventive concept, the dot may include six pixels (e.g., first to sixth pixels PX1, PX2, PX3, PX4, PX5, and PX6). However, the inventive concept is not limited thereto. The first and second pixels PX1 and PX2 may have a first color, the third and fourth pixels PX3 and PX4 may have a second color, and the fifth and sixth pixels PX5 and PX6 may have a third color. Each of the first to third pixels PX1, PX2, and PX3 may be any one of red, green, and blue colors. The first to third colors may be different colors. In FIG. 4, R denotes the color red, G denotes the color green, and B denotes the color blue.

The first and second pixels PX1 and PX2 may display an image based on the same gamma curve. For example, any one of the first and second gamma curves G1 and G2 shown in FIG. 3 may be selected at every period of one frame, and an image based on the selected gamma curve may be displayed through the first and second pixels PX1 and PX2. For example, the first and second pixels PX1 and PX2 may display an image having a first grayscale (e.g., a high grayscale H higher than the reference grayscale) based on the first gamma curve G1 during the N-th frame (e.g., the first frame F1 or the third frame F3). The first and second pixels PX1 and PX2 may display an image having a second grayscale (e.g., a low grayscale L lower than the reference grayscale) based on the second gamma curve G2 during the (N+1)th frame (e.g., the second frame F2 or the fourth frame F4). As shown in FIG. 4, the first and second pixels PX1 and PX2 may have the red color.

The third and fourth pixels PX3 and PX4 may also display an image based on the same gamma curve. For example, any one of the first and second gamma curves G1 and G2 shown in FIG. 3 may be selected at every period of one frame, and an image based on the selected gamma curve may be displayed through the third and fourth pixels PX3 and PX4. For example, the third and fourth pixels PX3 and PX4 may display an image having the second grayscale L based on the second gamma curve G2 during the N-th frame (e.g., the first frame F1 or the third frame F3). The third and fourth pixels PX3 and PX4 may display an image having the first grayscale H based on the first gamma curve G1 during the (N+1)th frame (e.g., the second frame F2 or the fourth frame F4). As shown in FIG. 4, the third and fourth pixels PX3 and PX4 may have the green color.

The fifth and sixth pixels PX5 and PX6 may display images based on different gamma curves in the first and second gamma curves G1 and G2, respectively. The fifth pixel PX5 may display an image having the first grayscale H based on the first gamma curve G1 during the N-th frame (e.g., the first frame F1 or the third frame F3). On the other hand, the fifth pixel PX5 may display an image having the second gray scale L based on the second gamma curve G2 during the (N+1)th frame (e.g., the second frame F2 or the fourth frame F4). On the contrary, the sixth pixel PX6 may display an image having the second grayscale L based on the second gamma curve G2 during the N-th frame (e.g., the first frame F1 or the third frame F3). The sixth pixel PX6 may display an image having the first grayscale H based on the first gamma curve G1 during the (N+1)th frame (e.g., the second frame F2 or the fourth frame F4). As shown in FIG. 4, the fifth and sixth pixels PX5 and PX6 may have the blue color.

Synthetically, in one dot, both pixels expressing (e.g., having) a first color may display an image having the first grayscale H, both pixels expressing a second color may display an image having the second grayscale H, and both pixels expressing a third color may display images having the first and second grayscales H and L, respectively. Also, in one dot, the number of pixels displaying the image having the first grayscale H may be equal to the number of pixels displaying the image having the second grayscale L.

Thus, it may be possible to prevent a phenomenon that moving line spots may occur when an image moves in the vertical and horizontal directions while balancing grayscales in one dot.

Data voltages including grayscale information may be applied to the first to sixth pixels PX1 to PX6, respectively. Each data voltage may have a positive (+) or negative (−) polarity with respect to a reference voltage applied to the common electrode CE shown in FIG. 2. In FIG. 4, the polarity of a data voltage applied to each pixel PX for each frame is shown. The polarity of the data voltage may be inverted at every period of one frame or may be inverted at every period of two frames.

When the polarity of the data voltage is inverted at every period of one frame, each of the pixels PX1 to PX6 may receive a data voltage having any one of the positive (+) and negative (−) polarities during the first frame F1, and may receive a data voltage having the other of the positive (+) and negative (−) polarities during the second frame F2. When the polarity of the data voltage is inverted at every period of two frames, each of the pixels PX1 to PX6 may receive a data voltage having the same polarity during the first and second frames F1 and F2. In FIG. 4, it has been exemplarily illustrated that the polarity of the data voltage is inverted at every period of two frames. However, the inventive concept is not limited thereto.

The first, third, and fifth pixels PX1, PX3, and PX5 may be located on a k-th (e.g., k is an integer which is equal to or greater than 1 and smaller than m) row, and the second, fourth, and sixth pixels PX2, PX4, and PX6 may be located on a (k+1)th row. Thus, the first, third, and fifth pixels PX1, PX3, and PX5 may be connected to a k-th gate line among the plurality of gate lines G1 to Gm shown in FIG. 1, and the second, fourth, and sixth pixels PX2, PX4, and PX6 may be connected to a (k+1)th gate line among the plurality of gate lines G1 to Gm.

In an exemplary embodiment of the inventive concept, the first, third, and fifth pixels PX1, PX3, and PX5 may be connected to j-th, (j+1)th, and (j+2)th (e.g., j is an integer which is equal to or greater than 1 and smaller than n) data lines among the plurality of data lines D1 to Dn shown in FIG. 1, respectively, and the second, fourth, and sixth pixels PX2, PX4, and PX6 may be connected to (j+1)th, (j+2)th, and (j+3)th data lines among the plurality of data lines D1 to Dn, respectively. This connection structure may be defined as a staggered structure. Here, the polarity of a data voltage applied to the plurality of data lines D1 to Dn shown in FIG. 1 may be inverted at every period of one data line. When the pixels PX are connected with the staggered structure as described above, it may be possible to invert the polarity of the data voltage applied to each of the pixels PX1 to PX6 at every period of one pixel PX in the first and second directions DR1 and DR2.

When the above-described structure is employed, the moving line spots phenomenon might not be visible. A reason why the moving line spots phenomenon might not occur will be described below with reference to drawings.

Figure 5A:
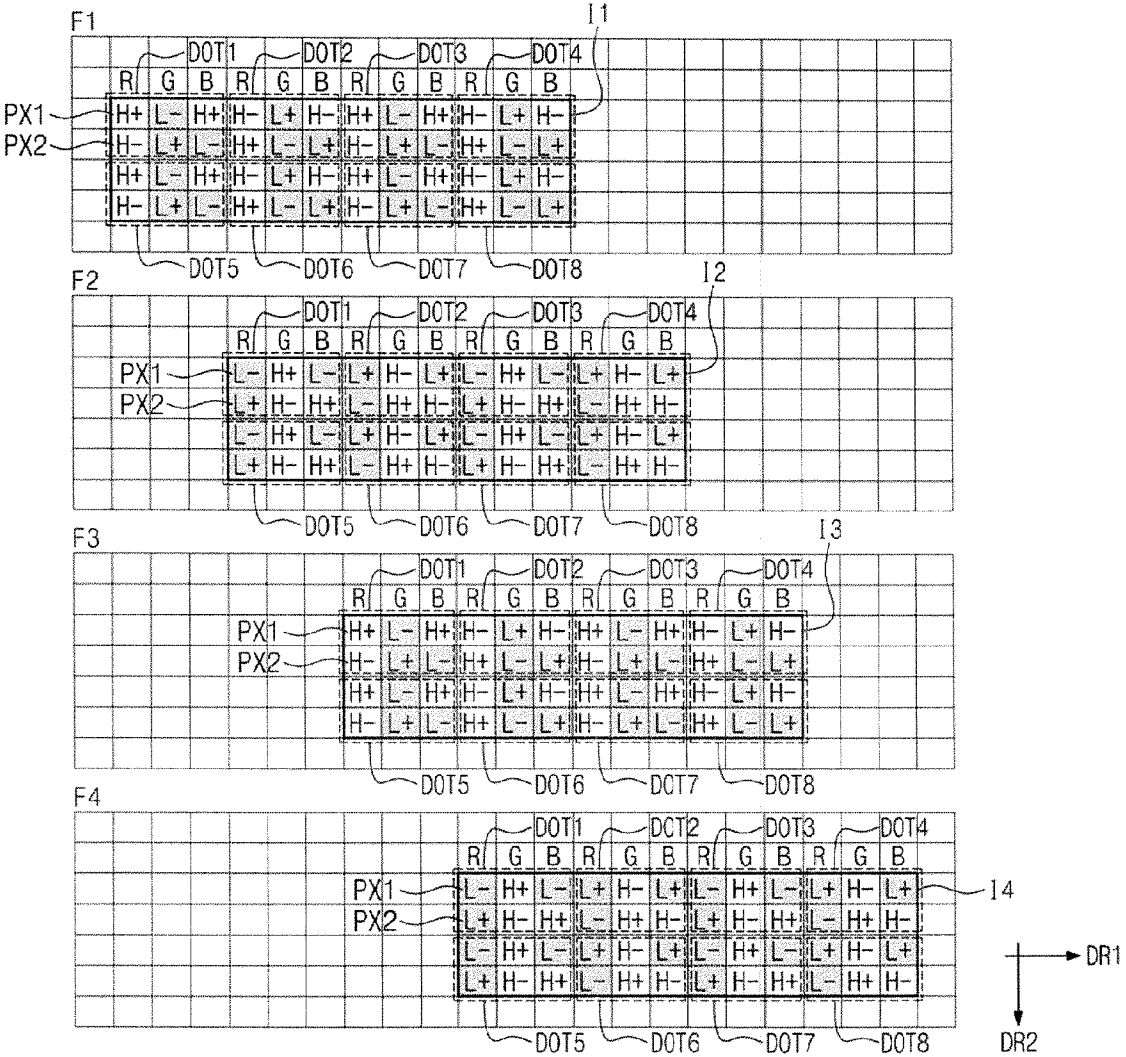
FIG. 5A is a view showing, as an example, a case where an image moves by a dot in the horizontal direction at every period of one frame, according to an exemplary embodiment of the inventive concept.
Figure 5B:
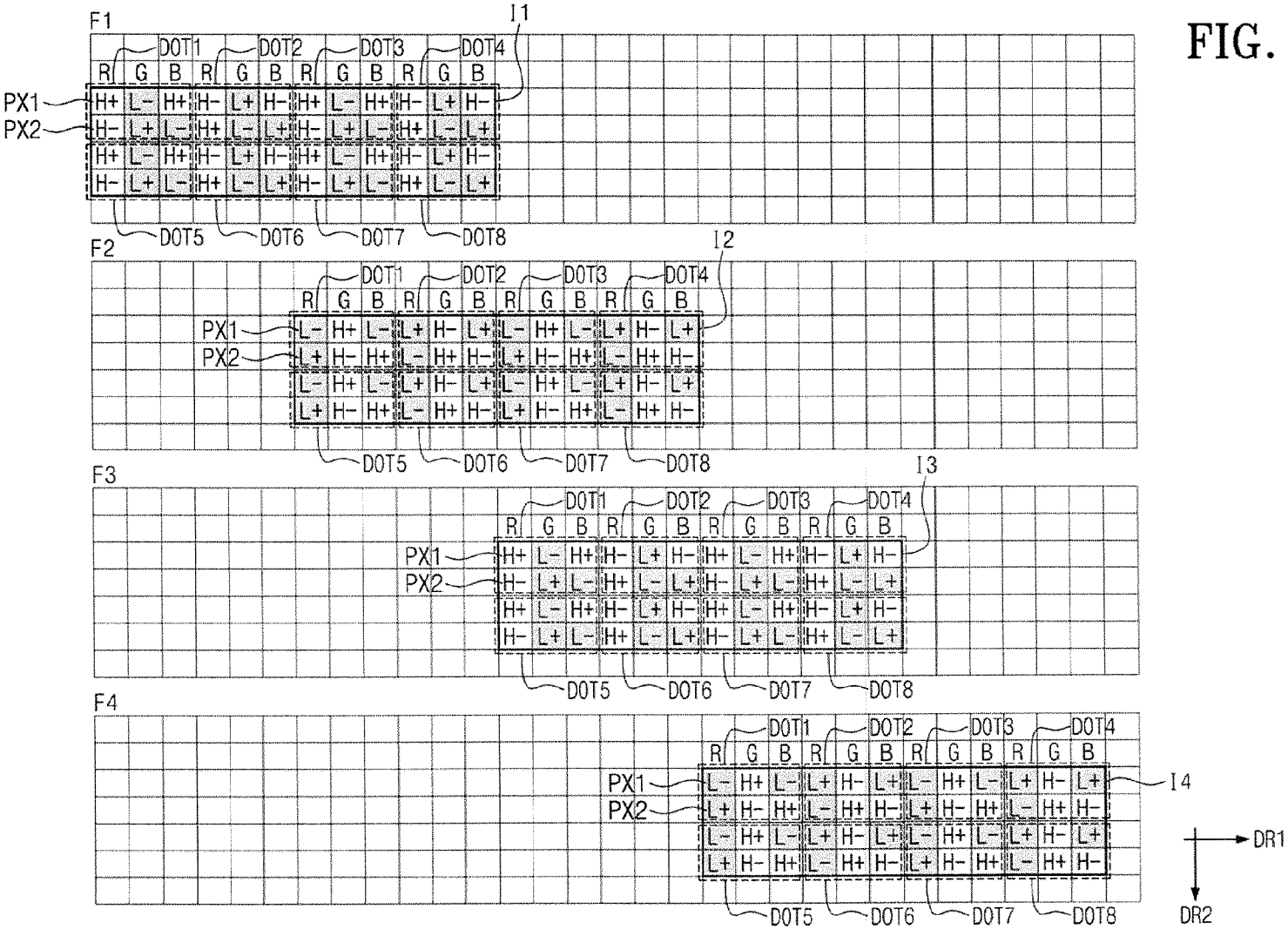
FIG. 5B is a view showing, as an example, a case where an image moves by two dots in the horizontal direction at every period of one frame, according to an exemplary embodiment of the inventive concept.

FIG. 5A is a view showing, as an example, a case where an image moves by a dot in the horizontal direction at every period of one frame, according to an exemplary embodiment of the inventive concept. FIG. 5B is a view showing, as an example, a case where an image moves by two dots in the horizontal direction at every period of one frame, according to an exemplary embodiment of the inventive concept. In FIGS. 5A and 5B, the case where the polarity of a data voltage is inverted at every period of one frame has been illustrated according to an exemplary embodiment of the inventive concept. However, the inventive concept is not limited thereto.

Referring to FIG. 5A, a dot is repeatedly disposed (e.g., arranged) in the horizontal direction (e.g., the first direction DR1) and the vertical direction (e.g., the second direction DR2). It is assumed that 12×4 pixels are turned on to display a first image I1 having a quadrangular shape on a screen during the first frame F1. In an exemplary embodiment of the inventive concept, the first image I1 may be an image expressed (e.g., displayed) with operations of eight dots (e.g., first to eighth dots DOT1 to DOT8). When the display apparatus 1000 displays an image moving by a dot in the horizontal direction DR1 at every period of one frame, a second image I2 may be displayed at a position where the first image I1 moves by one dot in the horizontal direction DR1 during the second frame F2.

In this case, the first dot DOT1 of the second image I2 may be defined as a dot located in a location corresponding to the second dot DOT2 of the first image I1. As shown in FIG. 5A, the first pixel PX1 in the first dot DOT1 of the first image I1 during the first frame F1 displays a grayscale of H+, and the first pixel PX1 in the first dot DOT1 of the second image I2 during the second frame F2 displays a grayscale of L−. When viewed spatially, the first pixel PX1 in the first dot DOT1 during the second frame F2 corresponds to the first pixel PX1 in the second dot DOT2 during the first frame F1. When each pixel PX is driven in the TGM manner, the first pixel PX1 in the second dot DOT2 during the first frame F1 displays the grayscale of H−, and the first pixel PX1 in the first dot DOT1 during the second frame F2 displays the grayscale of L−.

A third image I3 may be displayed at a position where the second image I2 moves by one dot in the horizontal direction DR1 during the third frame F3, and a fourth image I4 may be displayed at a position where the third image I3 moves by one dot in the horizontal direction DR1 during the fourth frame F4.

Although an image may move by every (e.g., one) dot in the horizontal direction DR1 as described above, the first pixel PX1 in the first dot DOT1 may display, for example, grayscales in the form of H+L−H+L− during four consecutive frames. Thus, a user might not view a moving line spot in the movement of the image. In an approach, when the image moves by every dot in the horizontal direction DR1, the first pixel PX1 in the first dot DOT1 may continuously display the same grayscale in the form of H+H−H+H− even though the frame is changed. Then, the difference in luminance between the grayscales of H and L may be viewed as a line spot, and therefore, a moving line spot may occur.

Referring to FIG. 5B, a dot may be repeatedly disposed in the horizontal and vertical directions DR1 and DR2. It is assumed that 12×4 pixels are turned on to display a first image I1 having a quadrangular shape on a screen during the first frame F1. When assuming that the display apparatus 1000 displays an image moving by every second dot (e.g., every two dots) in the horizontal direction DR1 at every period of one frame, a second image I2 may be displayed at a position where the first image I1 moves by two dots in the horizontal direction DR1 during the second frame F2.

In this case, the first dot DOT1 of the second image I2 may be defined as a dot located in a location corresponding to the third dot DOT3 of the first image H. As shown in FIG. 5B, the first pixel PX1 in the first dot DOT1 of the first image I1 during the first frame F1 displays a grayscale of H+, and the first pixel PX1 in the first dot DOT1 of the second image I2 during the second frame F2 displays a grayscale of L−. When viewed spatially, the first pixel PX1 in the first dot DOT1 during the second frame F2 corresponds to the first pixel PX1 in the third dot DOT3 during the first frame F1. When each pixel is driven in a time division manner, the first pixel PX1 in the third dot DOT3 during the first frame F1 may display the grayscale of H+, and the first pixel PX1 in the first dot DOT1 during the second frame F2 may display the grayscale of L−.

Next, a third image I3 may be displayed at a position where the second image I2 moves by two dots in the horizontal direction DR1 during the third frame F3, and a fourth image I4 may be displayed at a position where the third image I3 moves by two dots in the horizontal direction DR1 during the fourth frame F4.

Although an image may move by every second dot in the horizontal direction DR1 as described above with reference to FIG. 5B, the first pixel PX1 in the first dot DOT1 may display, for example, grayscales in the form of H+L−H+L− during four consecutive frames. Thus, a user might not view a moving line spot in the movement of the image. However, according to an approach, when the image moves by every second dot in the horizontal direction DR1, the first pixel PX1 in the first dot DOT1 may continuously display the same grayscale in the form of H+H−H+H− even though the frame is changed. Thus, the difference in luminance between the grayscales of H and L may be viewed as a line spot, and therefore, a moving line spot may occur.

Figure 6A:
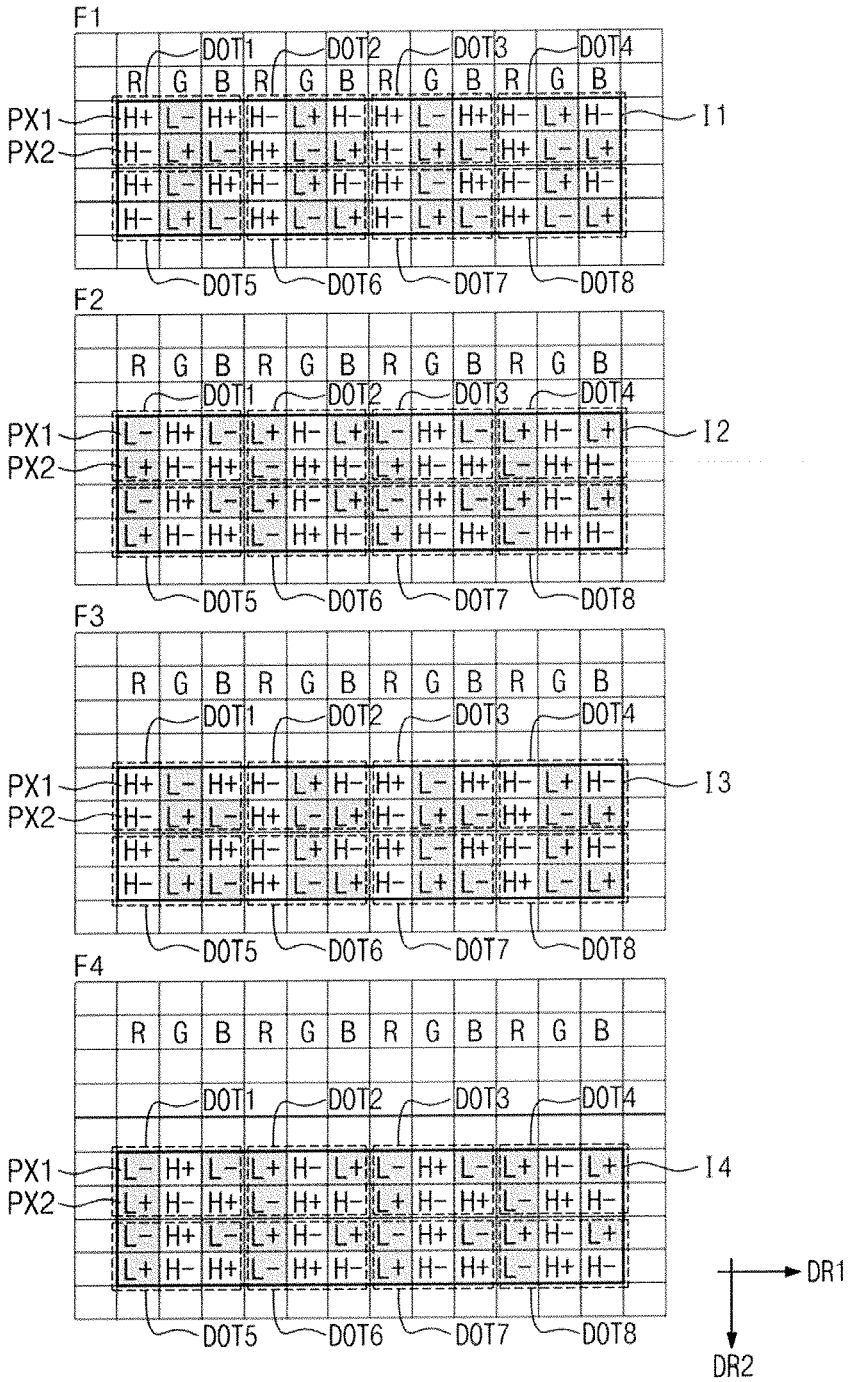
FIG. 6A is a view showing, as an example, a case where an image moves by a pixel in the vertical direction at every period of one frame, according to an exemplary embodiment of the inventive concept.
Figure 6B:
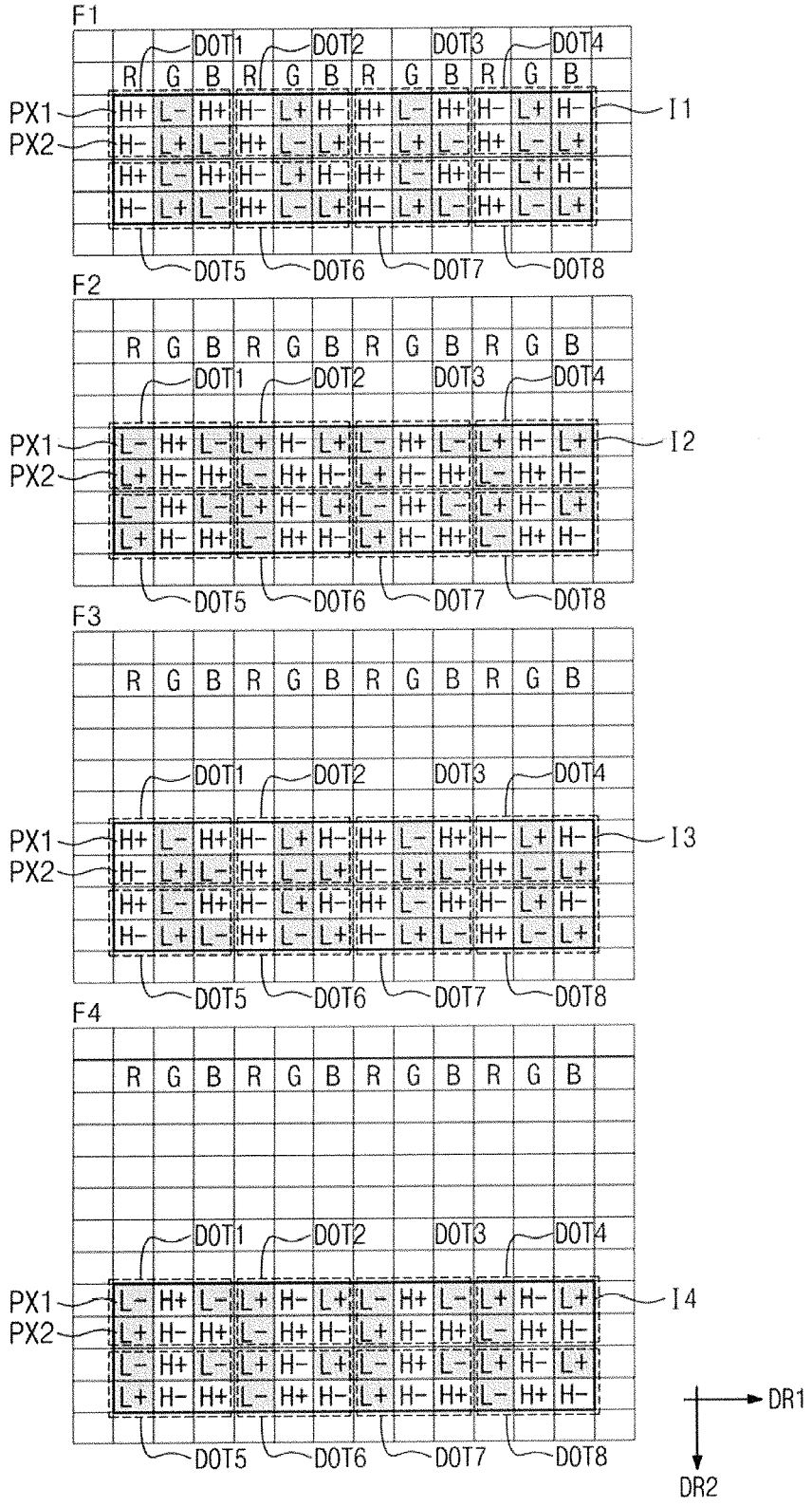
FIG. 6B is a view showing, as an example, a case where an image moves by two pixels in the vertical direction at every period of one frame, according to an exemplary embodiment of the inventive concept.

FIG. 6A is a view showing, as an example, a case where an image moves by a pixel in the vertical direction at every period of one frame, according to an exemplary embodiment of the inventive concept. FIG. 6B is a view showing, as an example, a case where an image moves by two pixels in the vertical direction at every period of one frame, according to an exemplary embodiment of the inventive concept. In FIGS. 6A and 6B, the case where the polarity of a data voltage is inverted at every period of one frame has been illustrated according to an exemplary embodiment of the inventive concept.

Referring to FIG. 6A, a dot may be repeatedly disposed in the horizontal and vertical directions DR1 and DR2. It is assumed that 12×4 pixels are turned on to display a first image I1 having a quadrangular shape on a screen during the first frame F1. When the display apparatus 1000 displays an image moving by a pixel in the vertical direction DR2 at every period of one frame, a second image I2 may be displayed at a position where the first image I1 moves by one-half dot in the vertical direction DR2 during the second frame F2.

In this case, the first pixel PX1 in the first dot DOT1 of the second image I2 may be defined as a pixel PX located in a location corresponding to the second pixel PX2 in the first dot DOT1 of the first image I1. As shown in FIG. 6A, the first pixel PX1 in the first dot DOT1 of the first image I1 during the first frame F1 may display a grayscale of H+, and the first pixel PX1 in the first dot DOT1 of the second image I2 during the second frame F2 may display a grayscale of L−. When viewed spatially, the first pixel PX1 in the first dot DOT1 during the second frame F2 corresponds to the second pixel PX2 in the first dot DOT1 during the first frame F1. When each pixel is driven in the TGM manner, the second pixel PX2 in the first dot DOT1 during the first frame F1 displays a grayscale of H−, and the first pixel PX1 in the first dot DOT1 during the second frame F2 displays the grayscale of L−.

Next, a third image I3 may be displayed at a position where the second image I2 moves by one pixel in the vertical direction DR2 during the third frame F3, and a fourth image I4 may be displayed at a position where the third image I3 moves by one pixel in the vertical direction DR2 during the fourth frame F4.

Although an image may move by a pixel in the vertical direction DR2 as described above, the first pixel PX1 in the first dot DOT1 displays, for example, grayscales in the form of H+L−H+L− during four consecutive frames. Thus, a user might not view a moving line spot in the movement of the image.

Referring to FIG. 6B, a dot may be repeatedly disposed in the horizontal and vertical directions DR1 and DR2. When the display apparatus 1000 displays an image moving by two pixels in the vertical direction DR2 at every period of one frame, a second image I2 may be displayed at a position where the first image I1 moves by two pixels in the vertical direction DR2 during the second frame F2.

In this case, the first pixel PX1 in the first dot DOT1 of the second image I2 may be defined as a pixel PX located in a location corresponding to the first pixel PX1 in the fifth dot DOT5 of the first image I1. As shown in FIG. 6B, the first pixel PX1 in the first dot DOT1 of the first image I1 during the first frame F1 displays the grayscale of H+, and the first pixel PX1 in the first dot DOT1 of the second image I2 during the second frame F2 displays the grayscale of L−. When viewed spatially, the first pixel PX1 in the first dot DOT1 during the second frame F2 corresponds to the first pixel PX1 in the fifth dot DOT5 during the first frame F1. When each pixel PX is driven in the time division manner, the first pixel PX1 in the fifth dot DOT5 during the first frame F1 may display the grayscale of H+, and the first pixel PX1 in the first dot DOT1 during the second frame F2 may display the grayscale of L−.

Next, a third image I3 may be displayed at a position where the second image I2 moves by two pixels in the vertical direction DR2 during the third frame F3, and a fourth image I4 may be displayed at a position where the third image I3 moves by two pixels in the vertical direction DR2 during the fourth frame F4.

Although an image may move by every two pixels PX in the vertical direction DR2 as described above, the first pixel PX1 in the first dot DOT1 may display, for example, grayscales in the form of H+L−H+L− during four consecutive frames. Thus, a user might not view any moving line spot in the movement of the image.

Figure 7:
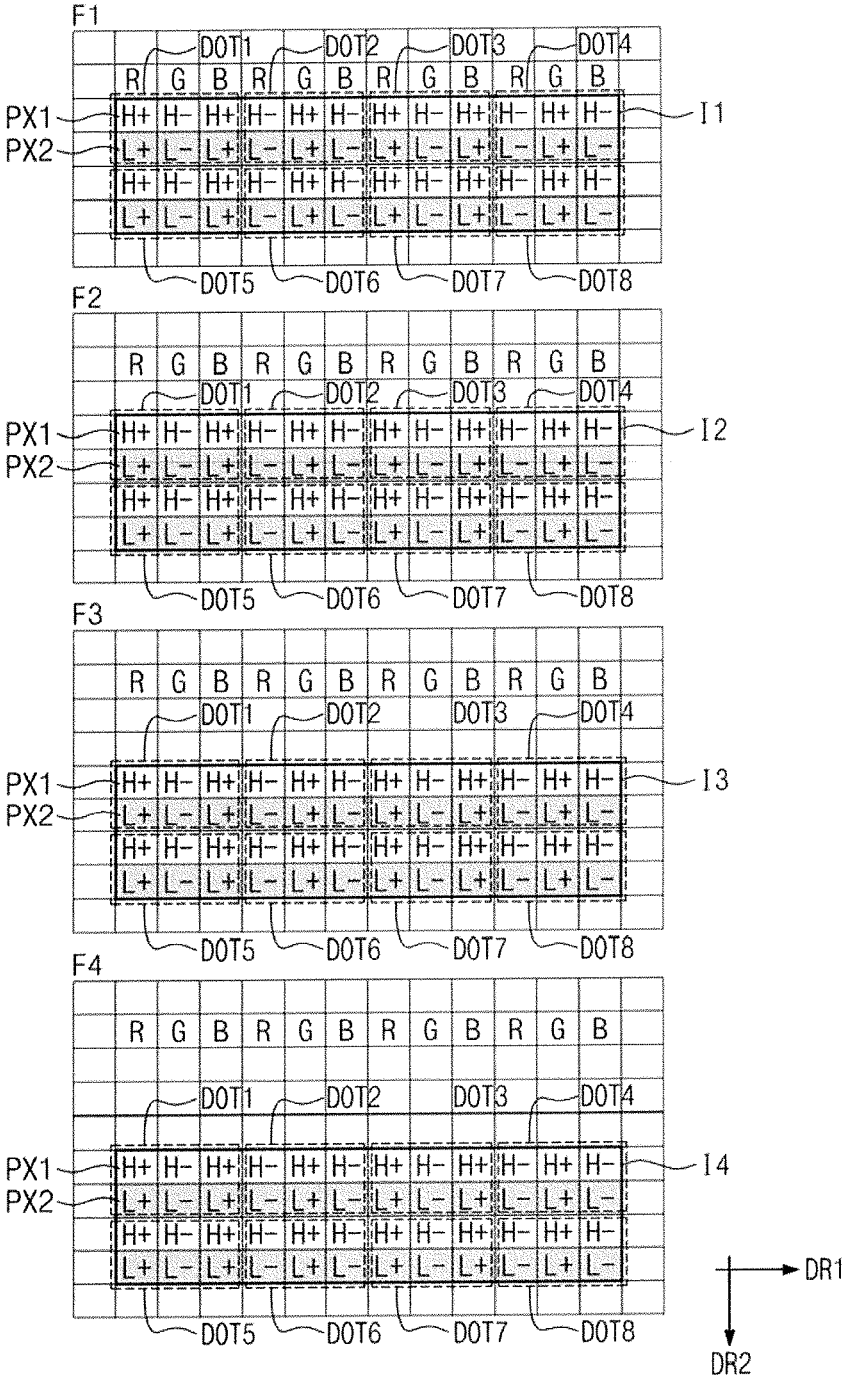
FIG. 7 is view showing a case where a moving line spot is viewed when an image moves by every pixel in the vertical direction at every period of one frame.

FIG. 7 is view showing a case where a moving line spot is viewed when an image moves by a pixel in the vertical direction at every period of one frame.

Referring to FIG. 7, when an image moves by a pixel PX in the vertical direction, the first pixel PX1 in the first dot DOT1 may continuously display the same grayscale in the form of H+H+H+H+ even though the frame is changed. Thus, the difference in luminance between the grayscales of H and L may be viewed as a line spot.

Figure 8:
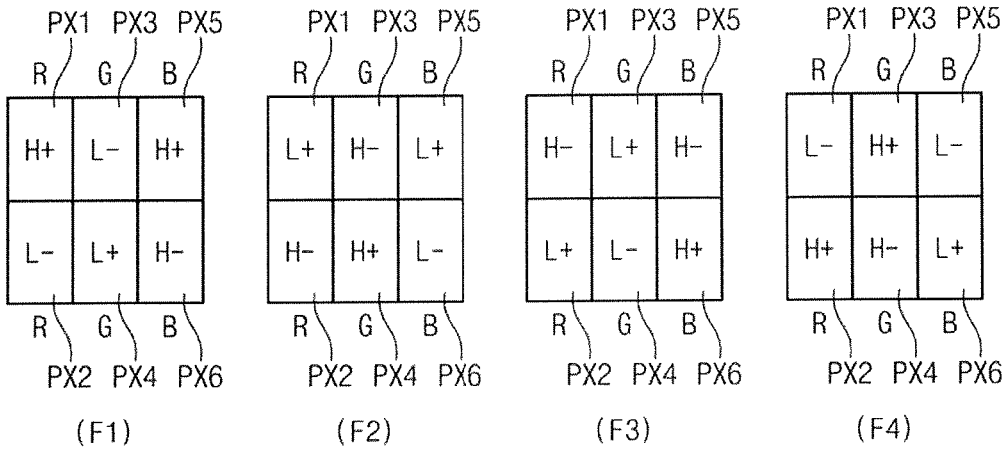
FIG. 8 is a view showing operation states of pixels during consecutive first to fourth frames according to an exemplary embodiment of the inventive concept.

FIG. 8 is a view showing operation states of pixels during consecutive first to fourth frames according to an exemplary embodiment of the inventive concept.

The dot may include first to sixth pixels PX1, PX2, PX3, PX4, PX5, and PX6. The first and second pixels PX1 and PX2 may have the red color, the third and fourth pixels PX3 and PX4 may have the green color, and the fifth and sixth pixels PX5 and PX6 may have the blue color.

The first and second pixels PX1 and PX2 may display images based on different gamma curves in the first and second gamma curves G1 and G2 shown in FIG. 3, respectively. When the first pixel PX1 may display an image having the first grayscale H based on the first gamma curve G1 during the N-th frame (e.g., the first frame F1 or the third frame F3), the first pixel PX1 may display an image having the second grayscale L based on the second gamma curve G2 during the (N+1)th frame (e.g., the second frame F2 or the fourth frame F4). On the contrary, when the second pixel PX2 may display an image having the second grayscale L based on the second gamma curve G2 during the N-th frame (e.g., the first frame F1 or the third frame F3), the second pixel PX2 may display an image having the first grayscale H based on the first gamma curve G1 during the (N+1)th frame (e.g., the second frame F2 or the fourth frame F4).

The third and fourth pixels PX3 and PX4 may display an image based on the same gamma curve. Any one of the first and second gamma curves G1 and G2 shown in FIG. 3 may be selected at every period of one frame, and an image based on the selected gamma curve may be displayed through the third and fourth pixels PX3 and PX4. For example, the third and fourth pixels PX3 and PX4 may display an image having the second grayscale L based on the second gamma curve G2 during the N-th frame (e.g., the first frame F1 or the third frame F3). On the other hand, the third and fourth pixels PX3 and PX4 may display an image having the first grayscale H based on the first gamma curve G1 during the (N+1)th frame (e.g., the second frame F2 or the fourth frame F4).

The fifth and sixth pixels PX5 and PX6 may display an image based on the same gamma curve. Any one of the first and second gamma curves G1 and G2 may be selected at every period of one frame, and an image based on the selected gamma curve is displayed through the fifth and sixth pixels PX5 and PX6. For example, the fifth and sixth pixels PX5 and PX6 may display an image having the first grayscale H based on the first gamma curve G1 during the N-th frame (e.g., the first frame F1 or the third frame F3). On the other hand, the fifth and sixth pixels PX5 and PX6 may display an image having the second grayscale L based on the second gamma curve G2 during the (N+1)th frame (e.g., the second frame F2 or the fourth frame F4).

Synthetically, in one dot, both pixels expressing the blue color may display an image having the first grayscale H, both pixels expressing the green color may display an image having the second grayscale H, and both pixels expressing the red color may display images having the first and second grayscales H and L, respectively. Also, in one dot, the number of pixels displaying the image having the first grayscale H may be equal to the number of pixels displaying the image having the second grayscale L.

Thus, it may be possible to prevent the moving line spots phenomenon that may occur when an image moves in the vertical and horizontal directions while balancing grayscales in one dot.

According to an exemplary embodiment of the inventive concept, an invisible pixel PX structure may be employed. Thus, the lateral visibility of the display apparatus may be increased without any decrease in aperture ratio.

Further, it may be possible to prevent the moving line spots phenomenon that may be visible in the horizontal and vertical directions.

While the inventive concept has been described with reference to exemplary embodiments thereof, it will be understood by those skilled in the art that various modifications and changes may be made thereto without departing from the spirit and scope of the inventive concept as defined in the following claims.

What is claimed is:

1. A display apparatus comprising:

a dot formed from a plurality of pixels, each pixel displays a grayscale that is a sum of a first image displayed during an Nth frame and a second image displayed during an (N+1)th frame, wherein N is an integer equal to or greater than 1, wherein the dot comprises:

first and second pixels having a first color, the first pixel displaying an image having a first grayscale based on a first gamma curve, and the second pixel displaying an image having a second grayscale based on a second gamma curve;

third and fourth pixels having a second color, the third pixel displaying an image having the first grayscale based on the first gamma curve, and the fourth pixel displaying an image having the first grayscale based on the first gamma curve; and fifth and sixth pixels having a third color, the fifth pixel displaying an image having the second grayscale based on the second gamma curve, and the sixth pixel displaying an image having the second grayscale based on the second gamma curve.

2. The display apparatus of claim 1, wherein the first, second, and third colors are red, green, and blue colors, respectively.

3. The display apparatus of claim 1, wherein the first, second, and third colors are blue, green, and red colors, respectively.

4. The display apparatus of claim 1, wherein each pixel in the dot receives a data voltage having a polarity inverted at every period of one frame.

5. The display apparatus of claim 1, wherein each pixel in the dot receives a data voltage having a polarity inverted at every period of two frames.

6. The display apparatus of claim 1, wherein the first, third, and fifth pixels are located on a k-th row, and the second, fourth, and sixth pixels are located on a (k+1)th row.

7. The display apparatus of claim 6, further comprising:

a plurality of gate lines extending in a first direction; and a plurality of data lines extending in a second direction crossing the first direction, wherein the first, third, and fifth pixels are connected to a k-th gate line, among the plurality of gate lines, and the second, fourth, and sixth pixels are connected to a (k+1)th gate line, among the plurality of gate lines.

8. The display apparatus of claim 7, wherein the first pixel is connected to a j-th data line, the third pixel is connected to a (j+1)th data line, and the fifth pixel is connected to a (j+2)th data line, and wherein the second pixel is connected to the (j+1)th data line, the fourth pixel is connected to the (j+2)th data line, and the sixth pixel is connected to the (j+3)th data line.

9. The display apparatus of claim 8, wherein polarities of data voltages applied to the plurality of data lines is inverted at every consecutive data line.

10. The display apparatus of claim 1, wherein the first and second gamma curves have different luminance values at the same grayscale.

11. The display apparatus of claim 10, wherein the first gamma curve has a luminance value lower than a luminance value of the second gamma curve at the same grayscale.

12. The display apparatus of claim 1, wherein each of the N-th and (N+1)th frames has a sectional width of about 1/120 ms.

13. A display apparatus comprising:

a plurality of pixel groups for displaying images, wherein each pixel group of the plurality of pixel groups includes a plurality of pixels, wherein each pixel of at least one pixel group of the plurality of pixel groups displays a grayscale by adding a first image displayed during an Nth frame and a second image displayed during an (N+1)th frame, wherein N is an integer equal to or greater than 1, wherein the at least one pixel group comprises:

first and second pixels having a first color, the first pixel displaying an image having a first grayscale based on a first gamma curve, and the second pixel displaying an image having the first grayscale based on the first gamma curve;

third and fourth pixels having a second color, the third pixel displaying an image having a second grayscale based on a second gamma curve, and the fourth pixel displaying an image having the second grayscale based on the second gamma curve; and fifth and sixth pixels having a third color, the fifth pixel displaying an image having the first grayscale based on the first gamma curve, and the sixth pixel displaying an image having the second grayscale based on the second gamma curve.

14. The display apparatus of claim 13, wherein the first, second, and third colors are red, green, and blue colors, respectively.

15. The display apparatus of claim 13, wherein each pixel of the at least one pixel group receives a data voltage having a polarity inverted at a period of one frame.

16. The display apparatus of claim 13, wherein each pixel of the at least one pixel group receives a data voltage having a polarity inverted at a period of two frames.

17. The display apparatus of claim 13, wherein the first, third, and fifth pixels are located on a k-th row, and the second, fourth, and sixth pixels are located on a (k+1)th row.

18. The display apparatus of claim 17, further comprising:

a plurality of gate lines extending in a first direction; and a plurality of data lines extending in a second direction crossing the first direction, wherein the first, third, and fifth pixels are connected to a k-th gate line, among the plurality of gate lines, and the second, fourth, and sixth pixels are connected to a (k+1)th gate line, among the plurality of gate lines.

19. The display apparatus of claim 18, wherein the first pixel is connected to a j-th data line, the third pixel is connected to a (j+1)th data line, and the fifth pixel is connected to a (j+2)th data line, and wherein the second pixel is connected to the (j+1)th data line, the fourth pixel is connected to the (j+2)th data line, and the sixth pixel is connected to the (j+3)th data line.

20. A display apparatus comprising:

a dot, the dot comprising a plurality of pixels for displaying images, wherein each pixel in the dot displays a grayscale by adding a first image displayed during a first frame and a second image displayed during a second frame, wherein the dot comprises:

first and second pixels having a first color, the first pixel displaying an image having a first grayscale based on a first gamma curve, and the second pixel displaying an image having a second grayscale based on a second gamma curve;

third and fourth pixels having a second color, the third pixel displaying an image having the first grayscale based on the first gamma curve, and the fourth pixel displaying an image having the first grayscale based on the first gamma curve; and fifth and sixth pixels having a third color, the fifth pixel displaying an image having the second grayscale based on the second gamma curve, and the sixth pixel displaying an image having the second grayscale based on the second gamma curve.

* * * * *